United States Patent [19]

Berthiaume

[11] 3,982,594

[45] Sept. 28, 1976

[54] ECCENTRIC STABILIZER

[75] Inventor: Derek B. Berthiaume, Calgary, Canada

[73] Assignee: Bralorne Resources Limited, Calgary, Canada

[22] Filed: Sept. 10, 1975

[21] Appl. No.: 612,162

[30] Foreign Application Priority Data

June 15, 1975 Canada .....231,514

[52] U.S. Cl. ..... 75/337; 175/325; 175/345; 308/8.2

[51] Int. Cl.[2] ..... E21B 17/10

[58] Field of Search ..... 175/337, 325, 342–348, 175/355, 227–229; 308/8.2, 92, 93, 97, 108

[56] References Cited

UNITED STATES PATENTS

| | | | |
|---|---|---|---|
| 1,136,135 | 4/1915 | Hughes | 175/227 |
| 1,247,839 | 11/1917 | Hughes | 175/227 X |
| 1,745,650 | 2/1930 | Santiago | 175/346 X |
| 1,772,491 | 8/1930 | Koppl | 175/343 |
| 1,776,611 | 9/1930 | Akeyson | 175/346 X |
| 1,805,087 | 5/1931 | Hamer | 175/342 |
| 1,805,806 | 5/1931 | Cambell et al. | 175/346 X |
| 2,037,967 | 4/1936 | DeCosta | 175/337 |
| 3,897,837 | 8/1975 | Peterson | 175/347 |

*Primary Examiner*—Ernest R. Purser
*Assistant Examiner*—Richard E. Favreau
*Attorney, Agent, or Firm*—H. Wayne Rock

[57] ABSTRACT

A stabilizer for use in a blast hole drilling has a shaft connectable at each end to a drill string. A plurality of individual bushings are axially spaced along the shaft, and each bushing carries a roller reamer rotatable thereon. Each bushing has its inner bore eccentrically positioned relative to its outer surface, and each bushing is mounted to the shaft so that its major eccentricity is angularly offset from that of the other bushings. In this manner, large diameter roller reamers can be used and the rotational speed thereof is reduced thereby reducing wear and increasing life. There are sufficient rollers such that the stabilizer is centrally supported in the drill hole and will not waver as it rotates.

2 Claims, 6 Drawing Figures

ECCENTRIC STABILIZER

The present invention relates to the mining industry in general and to a roller reamer type stabilizer used in the drilling of blast holes in particular.

Current design philosophy, for drilling bit stabilizers in the mining industry, contends that maximizing stabilizer roller size increases the operational life of the stabilizer. This concept is based on maximizing wear surface area and minimizing operating rotation speeds. Experimental evidence supports this theory.

The stabilizers presently used in blast hole drilling are similar in design. They typically incorporate three longitudinally mounted rollers, equispaced on the circumference of the stabilizer body and equidistant from one end. This design has inherent weaknesses. Since the rollers are mounted equidistant from one end of the stabilizer, their radii may not overlap and this limits their effective diameter to less than one half of the operating diameter of the stabilizer. Other design considerations such as a required body integral air passage and required body torsional strength further limit roller diameter. These restrictions lead the designer to a search for superior component materials and sophisticated bearing systems to increase operating life. The end result, of course, is higher manufacturing costs.

The present invention is founded on the same concept of roller diameter maximization which is acknowledged as a desirable attribute of any stabilizer. It was recognized that working roller radii overlap was not a problem if the longitudinally mounted rollers were longitudinally staggered rather than positioned equidistant from one end. This has the effect of mounting the rollers eccentrically with respect to the stabilizer body. In theory this permits any large roller diameter but in practice a roller diameter slightly less than the working diameter of the stabilizer proves optimum. This invention also eliminates previous design limitations for, by increasing the inside diameter of the rollers and by using eccentric bushings to mount them, it is possible to provide a central shaft with an integral air passage and ample torsional strength. The design also allows for the replacement of individual components; repairs are easier; and mass production techniques are applicable since the design incorporates many identical components.

In its broad sense, therefore, the present invention contemplates a roller stabilizer comprising a shaft, means for connecting the shaft to a drill string, an axial fluid passage in the shaft, a plurality of axially spaced bushings mounted on the shaft, a plurality of generally annular roller means, each mounted on an outer peripheral surface of an associated bushing for rotation thereon, and means separating each bushing from its adjacent bushing, each bushing having an inner bore for receiving the shaft, the bore being eccentrically positioned relative to the peripheral surface, and each bushing being positioned on the shaft so that its major eccentricity is angularly offset from that of others of the bushings.

The present invention will be described in greater detail and with reference to the drawings wherein.

Figure 1:
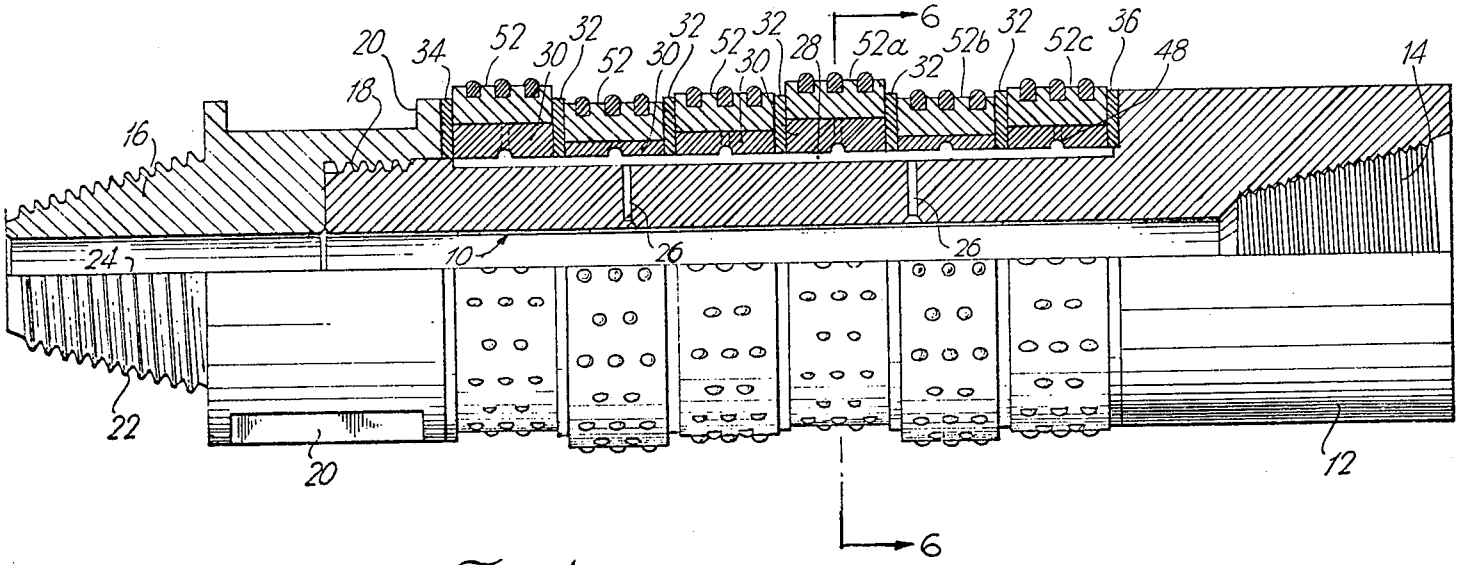
FIG. 1 shows the stabilizer of the present invention partially in section.

FIG. 1 illustrates the present invention in its assembled state. A main shaft 10 supports the majority of the components and has, at one end thereof, an enlarged box section 12 which includes an internal thread 14 for attachment to a drill string. At the opposite end, a pin end 16 is threaded to the shaft as at 18 and is provided with break-out slots 20 to aid in the attachment and removal of the stabilizer to the drill string. An external thread 22 is provided for attachment to the drill string and, while not shown, a locking pin can be used to lock the pin end to the shaft after assembly.

A central air passageway 24 extends the length of shaft 10 and pin end 16 and connects with the air passageways in the drill string thereby providing a continuous air passageway from drill head to drill bit. A plurality of radial passageways 26 extend from passageway 24, through the body of shaft 10 to connect with a longitudinally directed groove 28 formed in the outer surface of shaft 10.

Figure 3:
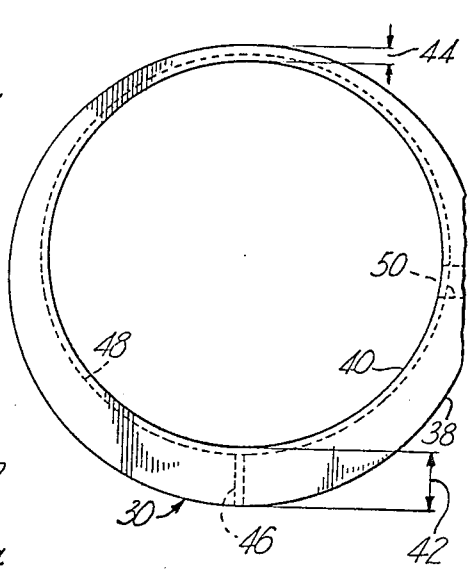
FIG. 3 shows an end view of a bushing.
Figure 2:
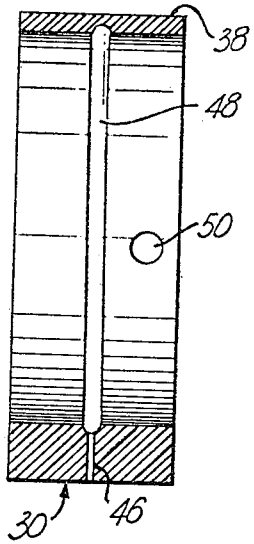
FIG. 2 shows a bushing in vertical section taken along the line 2—2 of FIG. 3.

With reference now to FIGS. 1, 2 and 3, it can be seen that a plurality of bushings 30 are mounted on shaft 10 in axially spaced relation separated from each other by a thrust washer 32, the end bushings being separated from the pin end 16 and box section 12 respectively by thrust washers 34 and 36 respectively. Each bushing 30 has an outer peripheral surface 38 and an inner bore 40 which is eccentrically positioned relative to surface 38 so as to provide major and minor eccentricities 42 and 44 respectively corresponding to the maximum and minimum thicknesses of the bushing body between the inner bore and the outer peripheral surface. Extending radially from the outer surface 38 to the inner bore 40 is a bore 46 which communicates with a circular groove 48 in the surface of the inner bore 40. While the bore 46 is shown in FIGS. 2 and 3 as being aligned along the major eccentricity, it can appear in other radial positions of the bushing body since it is intended to carry cooling and lubricating air from groove 28 to the interface between bushing 30 and roller 52. A bore 50 is provided in the body of bushing 30 to carry a locking pin, not shown, to lock the bushing to the shaft.

Figure 5:
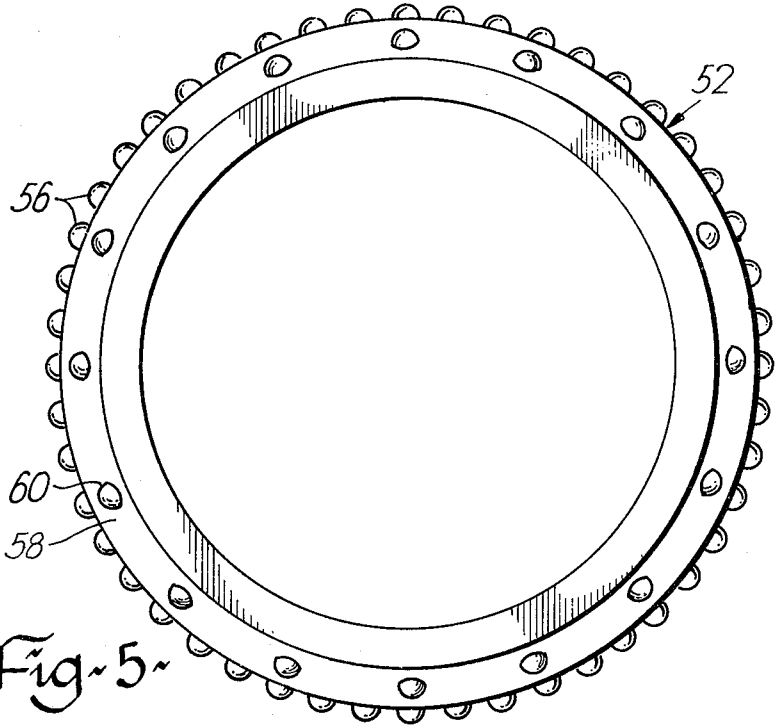
FIGS. 4 and 5 show a side view, partially in section, and an end view of a roller reamer used in the present invention.
Figure 4:
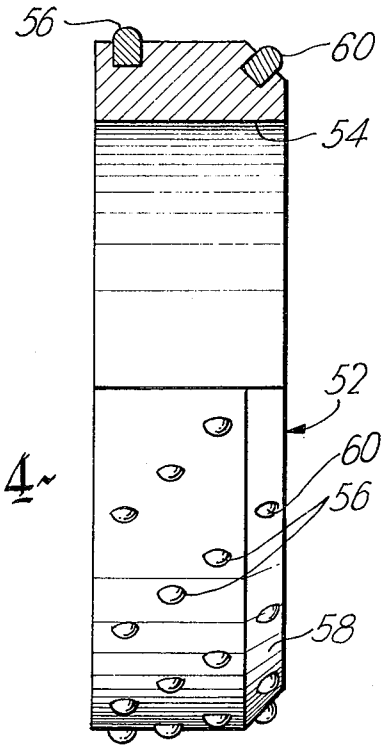

FIGS. 1, 4 and 5 show the roller means 52 which are mounted for rotation on the bushings, there being one roller means or reamer for an associated bushing. Each reamer is essentially annular in configuration, the inner bore 54 thereof mating with the outer peripheral surface 38 of the associated bushing. In accordance with known practice, the outer surface of each roller reamer is provided with a plurality of tungsten-carbide buttons 56 which contact the inner surface of the drill hole. If desired, the roller reamer can have one or both outer edges chamfered as at 58 and carrying buttons 60. It would be expected to use such chamfered reamers in the lowermost position on the shaft. The width of each reamer corresponds essentially to the distance between thrust washers 32.

In assembling the stabilizer of the present invention, the thrust washer 36 would first be positioned on the shaft 10 followed by the adjacent bushing 30 which would be locked in place. The roller reamer 52 for the first bushing would then be positioned on the bushing and the next thrust washer would be assembled to the shaft. The next bushing would be assembled so that its major eccentricity 42 would be angularly offset, typically by 120 degrees, from that of the first or adjacent bushing. The associated remaining roller reamers 52, thrust washers 32 and bushings 30 would then be assembled in such a manner that each bushing 30 has its major eccentricity angularly offset from those of the other bushings. In the example shown in FIG. 1, each bushing is offset by 120° from its neighbour and consequently the six bushings and reamers shown make up two sets of three bushings each, each set covering a full 360° of the shaft. Lastly, pin end 16 is assembled to the shaft 10 and locked in place. The stabilizer assembly can now be connected to a drill string.

Figure 6:
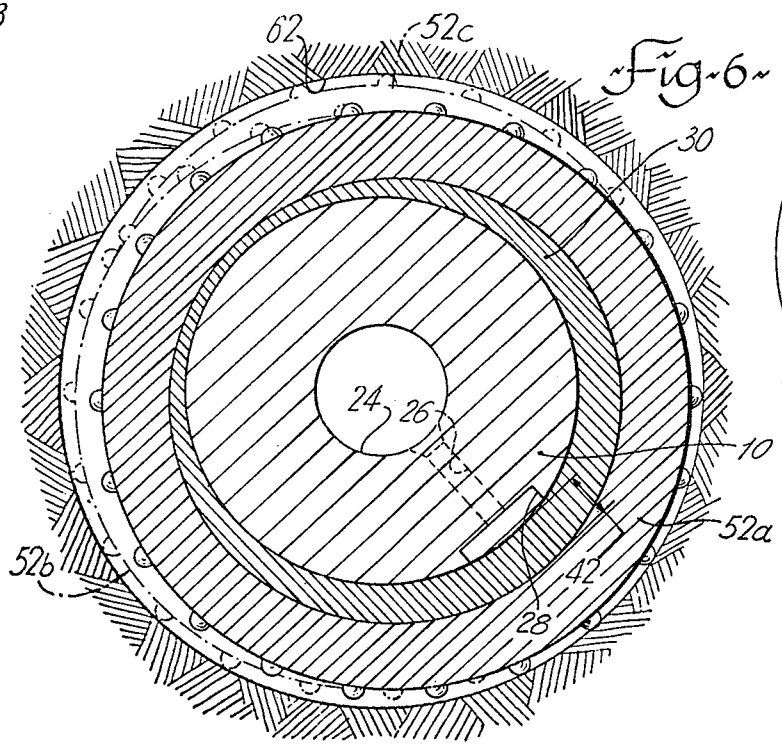
FIG. 6 shows the present invention in position in a drill hole, in section taken along line 6—6 of FIG. 1.

FIG. 6 shows the stabilizer of the present invention in position in a drill hole 62, with three of the reamers 52(A), 52(B) and 52(C) being shown. All six of the roller reamers contact the drill hole at points corresponding to the major eccentricity 42 of the associated bushing 30. Since there are two roller reamers in each of three radial orientations, there exists a two point support for each of the three orientations and therefore excellent axial and radial stability is provided. The roller reamers are only slightly smaller in diameter than the drill hole, consequently the roller speed is only slighlty greater than the drill speed. The increased roller size and surface produce greater distribution of wear, reducing wear rates. The passage of air through passageway 24, bores 26, groove 28, grooves 48 and bores 46 cleans and lubricates the rollers and the eccentric bearing surfaces. If service is required, removal of the pin end 16 and the shaft locking pin facilitates disassembly and replacement of worn parts. This repair may be carried out on site without welding facilities.

A particular embodiment of the present invention has been described herein, but it is not intended to restrict the invention to that embodiment since it is recognized that persons skilled in the art could effect other structural embodiments without departing from the spirit of the invention the limits of which are defined by the appended claims.

I claim:

1. A roller stabilizer comprising:

a cylindrical shaft;

means at each end of said shaft for connecting the stabilizer to a drill string;

an axial air passageway in said shaft;

a plurality of axially spaced bushings mounted in axially spaced relation on said shaft;

a plurality of thrust washers, each washer separating a bushing from the adjacent bushing;

a plurality of annular roller reamers, each being mounted for rotation on an outer peripheral surface of an associated bushing and having an axial length corresponding to the distance between the adjacent thrust washers; and a plurality of interconnected bores and grooves in said shaft and in said bushings to carry air from said axial air passageway to the outer peripheral surface of each bushing;

each bushing having an inner circular bore for receiving said shaft, said inner bore being eccentrically positioned relative to said outer peripheral surface, and each bushing being positioned on said shaft so that its major eccentricity is angularly offset from that of others of said bushings.

2. A roller stabilizer comprising:

a shaft;

means for connecting the shaft to a drill string;

an axial air passage in said shaft;

a longitudinal groove in the outer surface of said shaft;

a plurality of radially directed bores in said shaft communicating said groove with said air passage;

a plurality of axially spaced bushings on said shaft;

a plurality of annular roller means, each being mounted on an outer peripheral surface of an associated bushing for rotation thereon;

means separating each bushing from its adjacent bushing;

each bushing having an inner bore for receiving said shaft, the bore being eccentrically positioned relative to said peripheral surface;

each bushing being positioned on said shaft so that its major eccentricity is angularly offset from that of others of said bushings; and, each bushing including a circumferential groove in the inner surface defined by said inner bore and at least one bore communicating said circumferential groove with said peripheral surface.

* * * * *